United States Patent [19]

Chukhanov et al.

[11] 4,211,632

[45] Jul. 8, 1980

[54] METHOD FOR HEAT PROCESSING OF PULVERIZED BROWN COAL

[75] Inventors: Zinovy F. Chukhanov; Anatoly M. Nikolaev; Vadim A. Karasev; Elizaveta A. Shapatina; Zinovy Z. Chukhanov; Galina P. Zybalova; Nikolai A. Fedorov; Sergei A. Tsuprov, all of Moscow, U.S.S.R.

[73] Assignee: Gosudarstvenny Nauchno-Issledovatelsky Energetichesky Institut Imeni G.M. Krzhizhanovskogo, U.S.S.R.

[21] Appl. No.: 933,526

[22] Filed: Aug. 14, 1978

[51] Int. Cl.[2] ..... C10G 1/00

[52] U.S. Cl. ..... 208/8 R; 201/44

[58] Field of Search ..... 208/8 R; 201/44

[56] References Cited

U.S. PATENT DOCUMENTS

| | | | |
|---|---|---|---|
| 3,850,738 | 11/1974 | Stewart, Jr. et al. | 208/8 R |
| 3,944,480 | 3/1976 | Schroeder | 208/8 R X |
| 3,960,700 | 6/1976 | Rosen et al. | 208/8 R |
| 3,963,598 | 6/1976 | Manowitz et al. | 208/8 R |
| 4,118,201 | 10/1978 | Yan | 208/8 R X |

*Primary Examiner*—Delbert E. Gantz
*Assistant Examiner*—William G. Wright
*Attorney, Agent, or Firm*—Steinberg and Blake

[57] ABSTRACT

According to the invention pulverized brown coal is processed by heating brown coal in two stages. During the first stage brown coal being processed is heated by a gaseous heat carrier to a temperature at which thermal decomposition of the brown coal begins. During the second stage the brown coal being processed is heated by the gaseous heat carrier to a temperature at which an intensive thermal decomposition of the brown coal takes place. The stream of the gaseous heat carrier delivered at the second stage of heating is fed with air oxygen and with low-grade products, such as heavy tars and pyrogenic water which are sprayed into the gaseous heat carrier.

5 Claims, 1 Drawing Figure

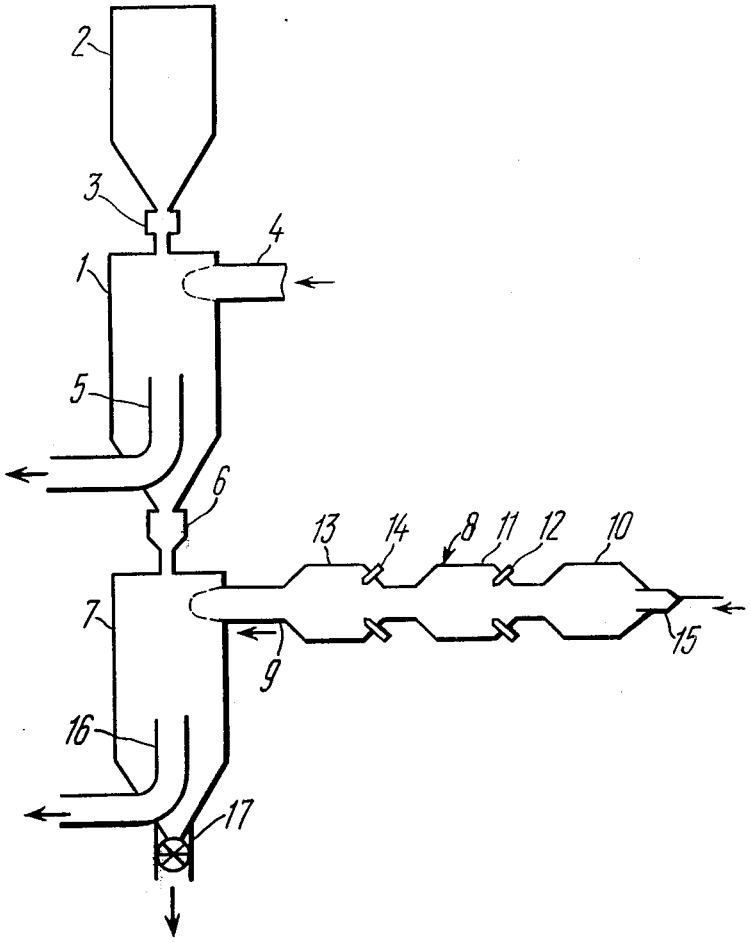
2
3
4
1
5
6
13
14
8
11
12
10
7
9
15
16
17

METHOD FOR HEAT PROCESSING OF PULVERIZED BROWN COAL

The invention relates to methods for the destructive processing of solid carbon-containing materials, by breaking down thereof and more specifically, to methods for heat processing of pulverized brown coals.

The invention is of particular advantage in energy and chemical industries where it can be used for combined production of high-calorific solid and synthetic liquid fuels as well as other gaseous and liquid products which are subsequently processed into technical and chemical raw materials.

BACKGROUND OF THE INVENTION

There are well known in the art methods for pyrolytic, or heat processing of pulverized solid fuels by which both usable products, including solid as well as liquid products, and low-grade products, such as heavy tars and pyrogenic water are produced.

Though the heat of combustion of heavy tars, on the order of 8400 kcal/kg, is known to be higher than that of the product being produced (whose heat of combustion is 6400–6700 kcal/kg), the utilization thereof presents a severe problem. This problem derives from the fact that under normal conditions tar is a sticky viscous substance which is neither sufficiently fluid to be delivered through pipelines nor sufficiently solid to be loaded into and delivered by transporting facilities to the consumer. Consequently, when heavy tar is used as a liquid boiler fuel, it is necessary to transform it into a liquid by heating, which naturally requires additional capital and operating expenses. Yet here, too, the problem of delivering heavy tars to the consumer stands.

Thus, due to heat processing of fuel, the product whose heat of combustion is 8400 kcal/kg practically cannot be used as fuel.

It is also known that pyrogenic water contains approximately 4.5% phenols dissolved therein which are usable products. However, to separate phenols from pyrogenic water requires a complicated procedure which again requires considerable capital and operating expenses. In addition, after the separation of phenols from pyrogenic water, the latter must be purified prior to disposal into a water pool.

As a consequence of the fact that world's natural energy resources are running thin, processing of large quantities of low-grade fuels is gaining in importance. Specifically, the problem of utilizing heavy tar and pyrogenic water which are low-grade products resulting from heat processing of fuels has become ever more acute.

There is known in the art a method for heat processing pulverized brown coal (USSR Inventor's Certificate No. 335267), comprising a first stage of heating the coal by a gaseous heat carrier in less than one second to a temperature of 200°–500° C. with subsequent separating of the heat carrier from the coal, a second stage of heating the coal by the gaseous heat carrier in less than one second to a temperature of 500°–800° C. at which an intensive thermal decomposition thereof takes place with the formation of a vapour-and-gas suspension consisting of a solid portion and a vapour-and-gas portion, condensing the vapour-and-gas portion to obtain gas and valuable liquid products, and to separate therefrom low-grade products, such as heavy tars and pyrogenic water.

The realization of the above method makes it possible to produce along with other usable products also low-grade products such as heavy tars and pyrogenic water whose utilization presents a problem not yet solved.

The object of the invention is to provide a method for heat processing of pulverized brown coal, which, with the power input equal to that of the conventional methods, ensures the production of a solid product with higher heat combustion.

Another object of the present invention is to provide a method for heat processing of pulverized brown coal, which enables utilization of low-grade products.

One more object of the invention is to provide a method for heat processing pulverized solid fuel, which makes it possible to realize pyrolytic processing of the heavy tar - a product of heat processing of brown coal.

Still another object of the present invention is to provide a method for processing of pulverized brown coal, which ehables utilization of organic substances dissolved in pyrogenic water.

SUMMARY OF THE INVENTION

These and other objects are achieved by the provision of a method for heat processing of pulverized brown coal comprising a first stage of heating the coal by a gaseous heat carrier in less than one second to a temperature of 200°–500° C. and subsequently separating the spent heat carrier from the coal, a second stage of heating the coal by the gaseous carrier in less than one second to a temperature of 500°–800° C. at which temperature an intensive thermal decomposition of the coal takes place with the formation of a vapour-and-gas suspension containing a solid portion and a vapour-and-gas portion, condensing the vapour-and-gas portion to obtain gas, usable liquid products and to separate low-grade products, such as heavy tars and pyrogenic water therefrom, wherein, according to the invention, at the second stage of heating the low-grade products of heat processing of pulverized brown coal are sprayed into the stream of the gaseous carrier containing air oxygen.

It is expedient to supply the stream of the gaseous heat carrier with heavy tar, the oxygen content in the gaseous carrier being sufficient for carrying out pyrolytic processing of the heavy tar at predetermined temperatures. Due to pyrolytic processing of the heavy tar, volatile components are liberated which burn and thereby raise the temperature of the gaseous heat carrier. In addition, there is formed a solid portion which is a high-calorific fuel.

It is good practice to supply the stream of the gaseous heat carrier with pyrogenic water, the gaseous heat carrier being supplied along the stream thereof, first with pyrogenic water and then with heavy tars. This prevents the necessity of purifying pyrogenic water prior to disposal thereof into water pools. In addition, organic solvents dissolved in pyrogenic water can be converted into usable products.

BRIEF DESCRIPTION OF THE DRAWINGS

The above-mentioned and other object of this invention will become more apparent by reference to the following description of an embodiment of the invention taken in conjunction with the accompanying drawing which shows a diagrammatic view of an apparatus for heat processing of pulverized brown coal.

DESCRIPTION OF THE PREFERRED EMBODIMENT OF THE INVENTION

When realizing the method for heat processing of pulverized brown coal, there is used an apparatus comprizing a chamber 1 adapted for the first-stage heating of coal. The apparatus has a hopper 2 communicating with the chamber 1 through a turnstile feeder 3. A connection pipe 4 of a device (not shown) for feeding the gaseous heat carrier tangentially adjoins the chamber 1. To discharge the spent gaseous heat carrier, the chamber 1 is provided with a pipe 5 coaxially installed therein and connected with a cyclone (not shown). A chamber 7 adapted for the second-stage heating of the fuel is successively connected to the chamber 1 through a feeder 6. Abutting the chamber 7 adapted for the second-stage heating of the coal is a means 8 for delivering the gaseous heat carrier into the chamber 7, the stream of the gaseous heat carrier being supplied with low-grade products. The means 8 is a pipeline 9 tangentially adjoining the chamber 7 adapted for the second-stage heating of the coal. The pipeline 9 is provided with a chamber 10 for fuel to be burnt therein and to form stack gas, with chamber 11 for pyrogenic water to be fed thereto through sprayers 12, and with a chamber 13 for heavy tars to be fed thereto through sprayers 14. The chamber 10 incorporates a burner 15 adapted to burn fuel in a mixture with air oxygen.

To discharge the vapour-and-gas mixture resulting from thermal decomposition of the brown coal, the chamber 7 adapted for the second-stage heating of fuel is provided with a pipe 16 coaxially positioned therein and connected with a cyclone (not shown) through a pipeline. Furthermore, the chamber 7 adapted for the second-stage heating of the brown coal is provided with a turnstile metering device 17 adapted to discharge the obtained solid product from the chamber 7.

According to the invention, the method for heat processing of pulverized brown coal is realized as follows.

The pulverized brown coal having the size of particles below 1 mm is preheated to a temperature of about 110° C. for drying and is thereafter fed by the feeder 3 from the hopper 2 into the chamber 1 adapted for the first-stage heating of the brown coal. Simultaneously an oxygen-free heat carrier in the form of stack gas having a temperature of no less than 500° C. is delivered into the chamber 1 through the connection pipe 4.

The heat carrier tangentially enters the chamber 1 adapted for the first-stage heating of the brown coal and draws the particles of the pulverized brown coal. Under the action of centrifugal and gravity forces the brown coal particles are thrown towards the wall of the chamber and descend in a vortex. The pulverized brown coal is heated by the heat carrier to a temperature of 200° to 500° C. The spent gaseous heat carrier cooled down to a temperature about 350° C. is discharged through the pipe 5 into the cyclone (not shown). A portion of the pulverized brown coal carried away by the heat carrier is separated therefrom in a conventional manner.

The feeder 6 feeds the brown coal being processed from the chamber 1 adapted for the first stage heating of the brown coal into the chamber 7 adapted for the second stage heating of the brown coal. Concurrently with the coal the gaseous heat carrier is fed into the chamber 7 adapted for the secondstage of heating through the means 8. According to the invention the gaseous heat carrier obtained by burning a fuel, such as gas, and by the formation of stack gas is supplied with low-grade products. This procedure is carried out in the following way.

A combustible gas or any other fuel mixed with air oxygen is fed into a burner 15. More than 50% of the combustible gas is burnt in the chamber 10, thereby forming a gaseous heat carrier containing air oxygen. Since approximately 50% of combustible substances are burnt in the chamber 10 wherein the heat carrier is formed, the temperature in this chamber reaches about 1200° C. It is to be noted that the process of burning and the temperature in the chamber 10 wherein the heat carrier formation takes place are regulated in a conventional manner and by conventional means and therefore should be clear to those skilled in the art. From the chamber 10 wherein the heat carrier formation takes place, the gaseous heat carrier enters the chamber 11 adapted for processing pyrogenic water. Simultaneously the stream of the gaseous heat carrier is supplied with pyrogenic water through the sprayers 12. In the chamber 11 adapted for processing pyrogenic water, there takes place evaporation of the water as well as oxidative pyrolysis of organic substances dissolved therein, in particular, phenols. On pyrolysis of organic substances, one portion thereof gets transformed, another portion burns, still another is deposited as carbon on pulverized particles of the obtained coke. Due to processing of the pyrogenic water, the temperature of the gaseous heat carrier drops to about 1000° C. The gaseous heat carrier having the temperature of 1000° C. is fed into the chamber 13 where processing of heavy tars takes place. The chamber 13 is continuously supplied through the sprayers 14 with heavy tars which become liquid after being heated. Due to the high temperature and oxidizing medium (the stream of the gaseous heat carrier contains oxygen), there takes place oxidative pyrolysis of heavy tars in the chamber 13. This being the case, partial conversion of the liquid organic compounds occurs, and the gas continues to burning. As a result of afterburning of gas and partial burning of the combustibles separated after the decomposition of heavy tars, the temperature of the heat carrier rises to 1200° C. The gaseous heat carrier together with solid particles contained therein which have been obtained as a result of thermal processing of the pyrogenic water and heavy tars enters the chamber 7 adapted for the second-stage heating of the coal whereupon oxygen of the gaseous heat carrier fully reacts and the heat carrier becomes mixed with the brown coal being processed which is fed by the feeder 6. Solid particles of the brown coal are whirled by the gaseous stream moving from the centre of the chamber 7 to its periphery through the hot gaseous heat carrier.

The gaseous heat carrier, giving up its heat to the brown coal heats it to a temperature of 500°–800° C. This being the case, there takes place an intensive thermal decomposition of the brown coal, giving a vapour-and-gas suspension containing a solid product (coke) in the form of pulverized particles and a vapour-and-gas mixture. The obtained solid product is discharged from the chamber 7 adapted for the second-stage heating of the brown coal by a turnstile metering device 17. Simultaneously, the obtained vapour-and-gas mixture is discharged into a cyclone (not shown) through a pipe 16 to be purified from solid particles. The purified vapour-and-gas suspension is delivered for condensation to yield usable liquid products and for separation of low-grade products in the form of heavy tars and pyrogenic water from those usable liquid products. Thus obtained low-grade products such as heavy tars and pyrogenic water are directed respectively, into the chamber 11 and the chamber 13 to be fed into the stream of the gaseous heat carrier.

EXAMPLE

Brown coal having the calorific value of 3500 kcal/kg, moisture content of 32 to 38%, ash content of 8% and sulphur content of 0.5% was pulverized until the size of particles was less than one mm, and preheated to a temperature of 110° C.

The thus obtained brown coal was delivered into chamber 1 for heating in a vortex stream by a gaseous heat carrier such as stack gas having a temperature of not lower than 500° C. In fractions of a second (about 0.3 sec) the coal was heated to a temperature of 200°-500° C., i.e. to the temperature at which thermal decomposition of the coal begins. Being heated so fast, the coal practically did not change its composition because one ton of the coal being processed yielded but 20 kg of mass consisting of pyrogenic water, gas and coal carry-off. The spent gaseous heat carrier having a temperature of about 350° was separated from the heated coal.

Heated to the temperature of the beginning of thermal decomposition, the coal was delivered into chamber 7 adapted for the second-stage heating of the brown coal where it was heated by the gaseous heat carrier having a temperature of about 1000° C. During 0.3 sec the brown coal was heated to a temperature of 500°-800° C. According to the invention the stream of the gaseous heat carrier containing 100 kg of air per 10 kg of combustible gas was supplied with 50 kg of pyrogenic water per ton. Concurrently with burning of gas, there took place evaporation of the water as well as separation and oxidative pyrolysis of organic substances dissolved in the water. Thus, though evaporation of the water generally requires about 600 kcal/kg, in this case, due to combustion of phenols dissolved in the pyrogenic water, the consumption of energy for the evaporation constituted but 150-200 kcal/kg. Furthermore, thermal decomposition of phenols resulted in the formation of an insoluble residue. 75 kg of pulverized heavy tars were introduced into chamber 13 through sprayers 14 to be fed into the gaseous heat carrier. Due to the high temperature and oxidizing medium (the stream of the gaseous heat carrier contained air oxygen), there took place pyrolysis of the heavy tar, partial conversion of liquid organic compounds and combustion of gas of the heat carrier. Thermal decomposition of the heavy tar resulted in the formation of a solid portion in the form of particles of coke. This being the case, the separated combustibles partially burnt, thereby raising the temperature of the gaseous heat carrier to about 1200° C.

Thus the heat carrier comprising products of thermal processing of the fuel was delivered into the chamber 7 adapted for the second-stage heating, in which chamber the brown coal was heated by the obtained gaseous heat carrier to a temperature of 500°-800° C. at which the coal was decomposed, thus yielding a vapour-and-gas suspension comprising a solid product in the form of pulverized particles and a vapour-and-gas mixture. The vapour-and-gas mixture (a portion) was directed for purification and condensation to obtain gas, usable liquid products and to separate low-grade products therefrom as heavy tars and pyrogenic water. The low-grade products thus obtained were fed into the chamber 11 and 13 for being processed therein. At the same time the obtained solid product was discharged by a metering device 17 from chamber 7 adapted for the second-stage heating of brown coal.

Realisation of the proposed method, namely pyrolytic processing of heavy tars and pyrogenic water gave 60-80% of the solid product, i.e. 50 kg from 75 kg of the heavy tars. The solid product having a calorific capacity of about 8200-8400 kcal/kg was deposited on the product of thermal processing of the pulverized brown coal. Thus, the obtained product comprises the product of thermal processing of the brown coal and product of pyrolytic processing of the heavy tars. Since the calorific capacity of the first from the above-mentioned products is about 6400-6700 kcal/kg and that of the second above-mentioned product is about 8200-8400 kcal/kg, the total calorific capacity is about 6930 kcal/kg, which is 230 kcal/kg higher than that of the solid product obtained in a conventional manner and having the calorific capacity of 6400-6700 kcal/kg. This results in increasing the solid portion by 18%. Also, it is to be noted that the yield of solid product having an increased calorific capacity is achieved without any increase in the power consumption, i.e. due to the combustion of combustibles which enter into the composition of low-grade products.

Brown coal as the fuel for the process is taken for illustration purposes only in this particular example. However, it should be evident for those skilled in the art that any other fuel can be used as the process material. With this in view, and according to conventional requirements, processing of charge fuel as well as low-grade products is carried out at temperature and time operating conditions being maintained in a conventional manner.

We claim:

1. Method of heat processing pulverized brown coal, which comprises heating pulverized brown coal in a first stage by a gaseous heat carrier in less than one second to a temperature of 200°-500° C. at which thermal decomposition thereof begins, separating the gaseous heat carrier from the thus heated brown coal, further heating the thus heated brown coals in a second stage in less than one second to a temperature of 500°-800° C. at which temperature thermal decomposition of the brown coal takes place by means of a stream of a gaseous heat carrier which has been supplied with air oxygen and low grade products from the processing of pulverized brown coal, thus forming a vapour-and-gas suspension, breaking the thus formed vapour-and-gas suspension into a solid matter and a vapour-and-gas portion, condensing the vapour-and-gas portion to obtain gas, usable liquid products and to separate low-grade products including heavy tars and pyrogenic water therefrom, thereby obtaining thermally processed brown coal of high caloric capacity.

2. The method of claim 1, wherein the stream of the gaseous heat carrier fed at said second stage of heating of the brown coal is supplied with heavy tars for carrying out pyrolytic processing thereof.

3. The method of claims 1 or 2, wherein the stream of the gaseous heat carrier fed at said second stage of heating the brown coal is supplied with pyrogenic water, the gas heat carrier being at the same time supplied along its stream, first with pyrogenic water and then with heavy tars.

4. Method according to claim 1 wherein said stream of gaseous heat carrier in the second stage is supplied at a temperature of about 1200° C. to the brown coal to be heated.

5. Method according to claim 1 wherein for the second stage heating the gaseous heat carrier is obtained by burning combustible gas to form a gaseous heat carrier containing air oxygen, pyrogenic water obtained from the processing of pulverized brown coal is added thereto whereby the water evaporates and organic substances contained therein are pyrolyzed, and heavy tars are then added thereto which burn to heat the gaseous heat carrier and simultaneously decompose the heavy tars.

* * * * *